United States Patent [19]

Dhelft

[11] 4,033,561

[45] July 5, 1977

[54] COOLING PLATES FOR BLAST FURNACES

[75] Inventor: Patrick Dhelft, Paris, France

[73] Assignee: SOFRESID, Societe Francaise d'Etude d'Installations Siderurgiques, Montreuil, France

[22] Filed: Aug. 16, 1976

[21] Appl. No.: 714,964

[30] Foreign Application Priority Data

Sept. 3, 1975 France ..... 75.26978

[52] U.S. Cl. ..... 266/193

[51] Int. Cl.[2] ..... C21B 7/10

[58] Field of Search ..... 122/6 A, 6 B; 266/190, 266/193, 194; 432/83

[56] References Cited

UNITED STATES PATENTS

| | | | |
|---|---|---|---|
| 2,671,658 | 3/1954 | Moore | 266/193 |
| 2,789,881 | 4/1957 | Hochmuth | 266/193 |
| 2,805,851 | 9/1957 | Becker et al. | 266/193 |
| 3,984,089 | 10/1976 | van Laar et al. | 266/193 |

*Primary Examiner*—Gerald A. Dost

*Attorney, Agent, or Firm*—Wenderoth, Lind & Ponack

[57] ABSTRACT

A cooling plate for circulating fluid for cooling the walls of shaft furnaces and particularly blast furnaces, the plate being placed between the refractory material to be cooled and the facing of the furnace to be protected. The cooling plate includes a frame formed by two bent tubular elements welded at their ends to separator plates, an independent stream of cooling fluid passing through each tubular element; and a flat hollow central element consisting of an inner double-walled panel welded to the inner periphery of the frame, this inner panel forming an enclosure through which passes an independent stream of the cooling fluid.

8 Claims, 8 Drawing Figures

Fig: 7
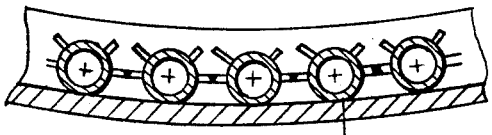
Fig: 5
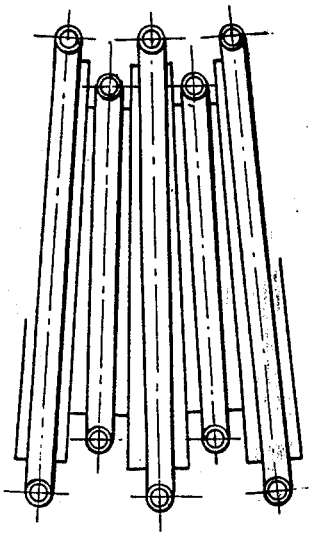
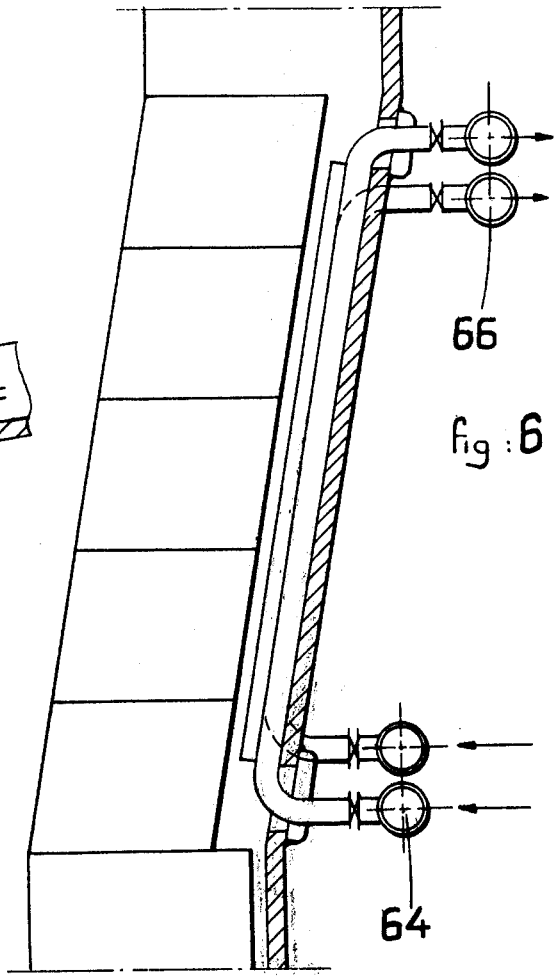
Fig: 6

COOLING PLATES FOR BLAST FURNACES

BACKGROUND OF THE INVENTION

The present invention relates to the cooling of the walls of shaft furnaces and more particularly, but not exclusively, to the cooling of the refractory walls of blast furnaces.

In the conventional constructions, the shafts and the boshes of blast furnaces are equipped with cooling boxes and/or trickle boxes. These boxes are intended to cool the brickwork and at the same time to support it. In the boshes, where the stability of the refractory material is assured, it may suffice to use a trickle system, but the boxes also enhance the service-life of the refractory materials. However, the use of such boxes involves the inconvenience that the noses of the boxes, deeply buried in the refractory material, are very soon subjected to abrasion by the downcoming charge and the upgoing stream of hot dust-laden gases because of the wear suffered by the refractory material. This results in a considerable number of boxes being used up.

The double-wall (water-jacket) technique has been developed for the purpose of effecting efficient cooling of the boshes and the bottom of the shaft. In this system, the local cooling effected by the boxes is replaced by cooling over the entire surface of the refractory material. The results achieved by the use of this technique have still not been satisfactory, so that use has been made of a combination of the double-wall system and the arrangement using cooling boxes. This process is however of limited application, since the heat-flow causes stresses in the sheet-metal parts of the installation.

For these reasons, it has been necessary to turn to the idea of effecting internal cooling in the most uniform manner possible. Therefore, in various countries internal cooling means have been designed which have consisted of a cast-iron plate in which were embedded steel tubes through which a stream of water was passed. These cooling means do not appear to have been completely satisfactory. In particular the plate becomes deformed, i.e., curved when heating takes place. The effect of this is to push out the refractory material, and this, on the one hand, breaks up the brickwork and, on the other, reduces cooling efficiency since the required contact between the cooling means and the wall to be cooled no longer exists.

SUMMARY OF THE INVENTION

The present invention is concerned with providing a cooling plate which does not suffer from the disadvantages affecting the known cooling arrangements.

According to one aspect of the invention there is provided a cooling plate for circulating fluid for cooling the walls of shaft furnaces and particularly blast furnaces, the plate being placed between the refractory material to be cooled and the facing of the furnace to be protected. The cooling plate includes a frame formed by two bent tubular elements welded at their ends to separator plates, an independent stream of cooling fluid passing through each tubular element; and a flat hollow central element consisting of an inner double-walled panel welded to the inner periphery of the frame, this inner panel forming an enclosure through which passes an independent stream of the cooling fluid.

This arrangement enables three independent cooling-fluid circulation paths to be formed, two of the paths formed by the tubular elements and the third by the inner double-walled panel. These three independent circulation paths continuously convey cooling fluid in the upward direction so that neither sedimentary deposits nor gas pockets can form.

In accordance with one embodiment of this invention, the inner double-walled panel is divided up into passages by means of partitions which also function as stiffening elements. These partitions enable the cooling fluid to circulate at a great velocity while sweeping the entire surface of the plate.

According to another aspect of the invention there is provided a cooling plate for the boshes of shaft furnaces and particularly blast furnaces, the plate taking the form of a screen of finned tubes welded to each other by two of their fins, and having inlets and outlets formed individually on at least two rows.

BRIEF DESCRIPTION OF THE DRAWINGS

Other features and advantages of this invention will emerge from the following description of non-limiting embodiments thereof. During this description reference will be made to the accompanying drawings in which:

FIGS. 5 to 7 illustrate a further modified form of the plate of the invention in front view, longitudinal section and cross-section respectively.

DETAILED DESCRIPTION OF THE INVENTION

Figure 1:
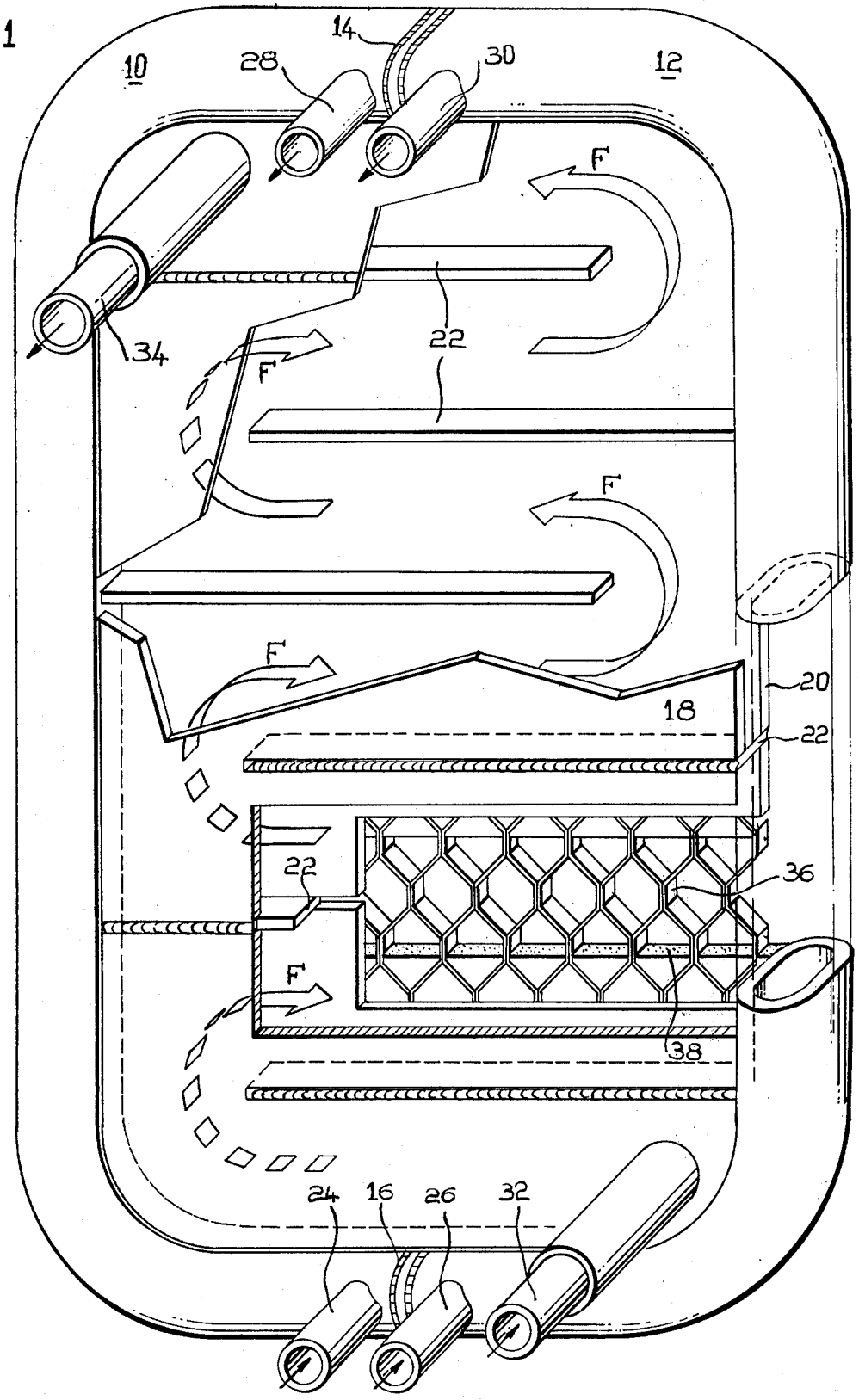
FIG. 1 is an isometric perspective view of a cooling plate in accordance with the invention, part of the plate being shown broken away.

Referring first to FIG. 1, which illustrates diagrammatically a cooling plate in accordance with the invention, this plate comprises a frame made of rolled steel tubing and formed by two bent tubular elements 10 and 12 which are welded at their ends on to plates 14 and 16 which separate the circulation paths. Each tubular element defines an independent cooling-fluid circulating path. For this purpose each of the elements 10 and 12 is supplied with cooling fluid at the bottom of the plate through pipes 24 and 26, respectively, which pass through the facing of the shaft furnace. The fluid issues at the top through pipes 28 and 30 which likewise pass through the facing.

There is further provided a flat hollow central element formed by an inner double-walled panel 18, 20. Each wall 18 and 20 consists of a steel plate, one of the plates 18 being disposed on the outside and the other, 20, on the inside. The plates are spaced by and interconnected by partitions 22. The latter serve as stiffening elements for this central element and at the same time delimit passages within the central element, which passages serve to impart an upward vertical sinusoidal movement to the cooling fluid, this movement being indicated in FIG. 1 by arrows F. Cooling fluid is supplied to the central element at its bottom by way of a pipe 32, and the fluid is discharged at the top through a pipe 34.

Means are provided for protecting the central element, which means consists of a known type of grating 36 which is secured to the inner plate 20 by any suitable means (not illustrated). This grating is filled level with a packing 38 made of a refractory product selected to suit the brickwork of the shaft furnace in which the cooling plate of the invention is used.

Figure 2A:
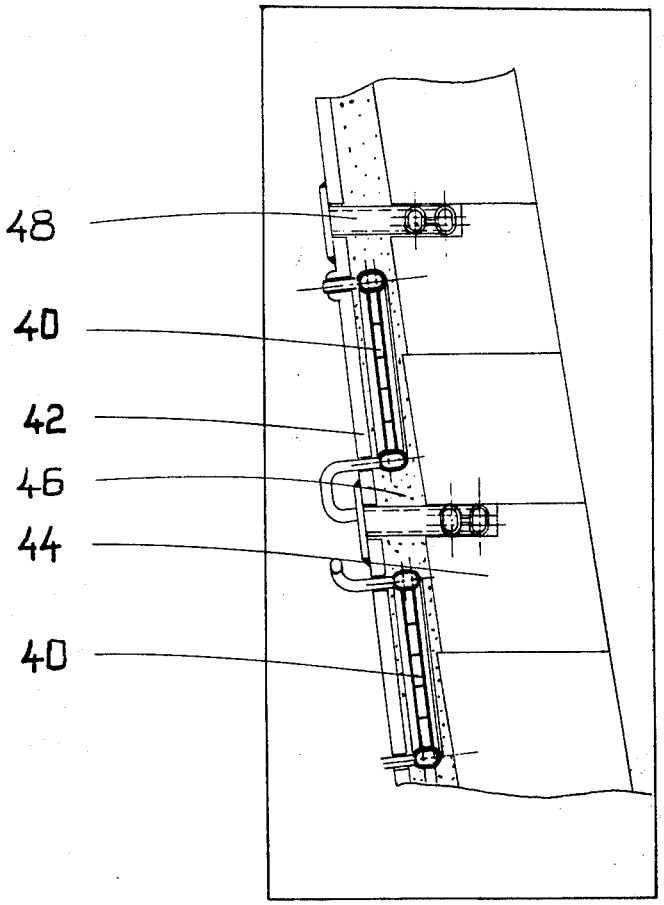
FIGS. 2*a* and 2*b* are a longitudinal section and a cross-section, respectively, through part of the wall of a shaft surface, and show the plate in accordance with the invention fitted between the facing and the refractory material.
Figure 2B:
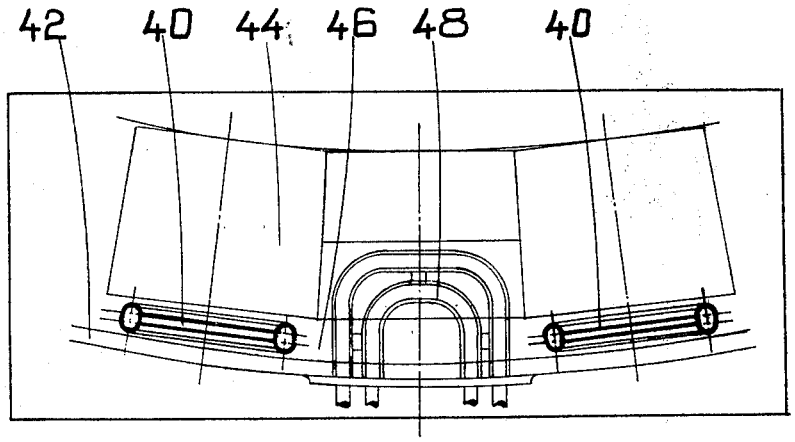

FIGS. 2*a* and 2*b* illustrate the arrangement of cooling plates in accordance with the invention in a shaft furnace.

In these Figures the cooling plates are each designated by the reference numeral 40. Each plate is disposed between the facing 42 of the furnace and the refractory wall 44. Contact between the various elements is ensured by a composition 46 of the refractory puddled clay type, which is selected to suit the nature of the brickwork of the shaft furnace equipped with cooling plates in accordance with the invention.

FIGS. 2*a* and 2*b* also show how the plates of the invention can be used in conjunction with conventional cooling boxes 48.

Figure 3:
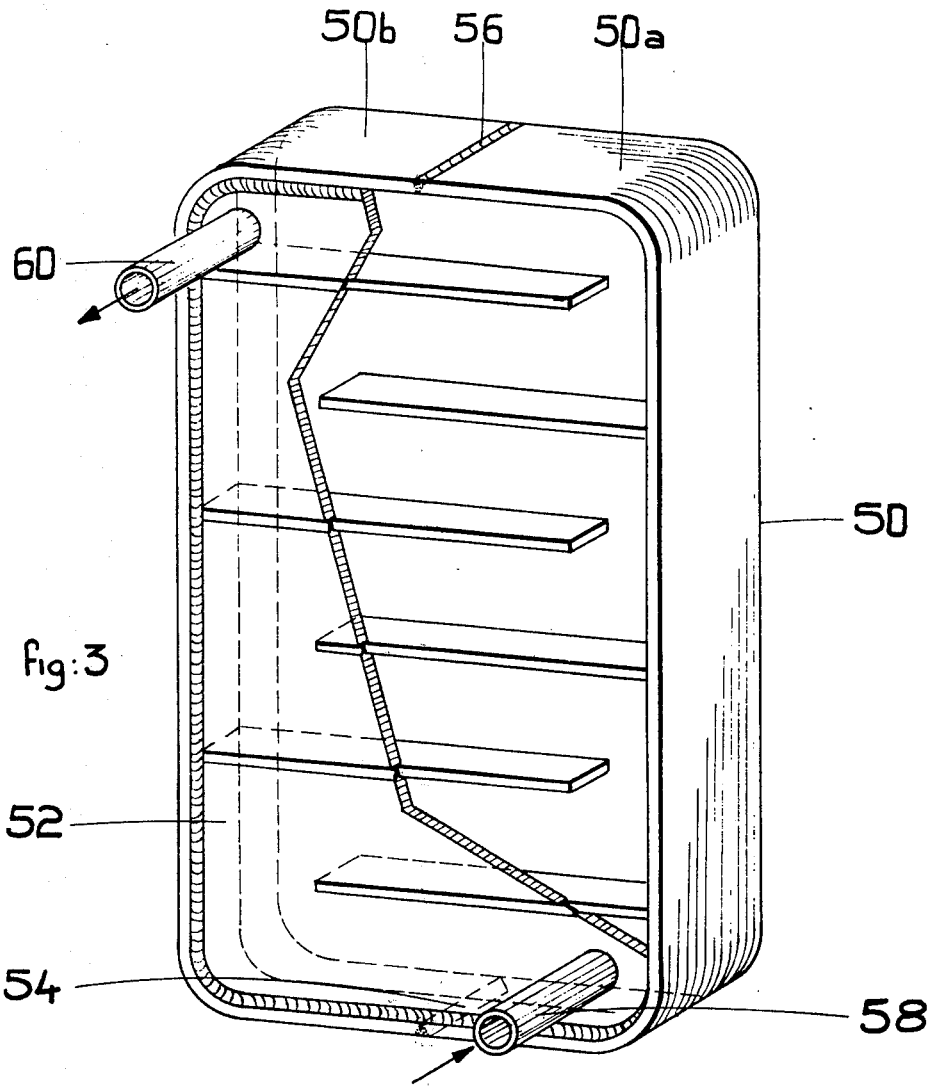
FIG. 3 is an isometric perspective view of a simplified modified form of the plate of the invention having one circulation path only, part of the plate being shown as broken away.
Figure 4:
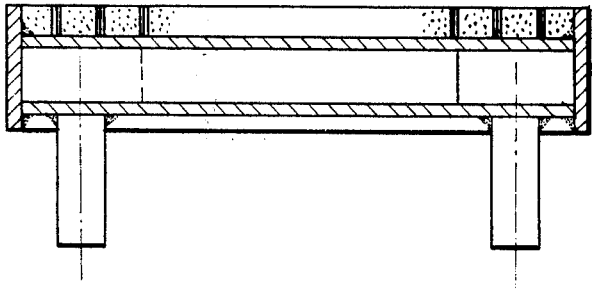
FIG. 4 is a cross-section through the FIG. 3 arrangement.

The modified form illustrated in FIGS. 3 and 4 is a simplified version of the plate described above. In this modified form the frame, designated as a whole by the reference numeral 50, is not made up of two tubular elements (10 and 12 in FIG. 1) but of two bent steel plates 50*a* and 50*b* which are butt-welded to each other at 54 and 56. A central element 52, formed in the same way as the central element of the cooling plate illustrated in FIG. 1, is secured in this frame 50, for example by welding. Thus, a plate having only one circulation path is formed, cooling fluid being supplied at the bottom at 58, and being discharged at the top at 60.

When the cooling plates in accordance with the invention have been fitted in the furnace as explained above with reference to FIGS. 2*a* and 2*b*, all that is then required is to connect the inlet and outlet pipes to a duct through which cooling fluid is circulated.

The rate of flow of fluid through each circulation path will be adjusted to provide a suitable heat-exchange. A rate of flow of 10 $m^3$/hour can be regarded as average. In order to limit consumption of cooling fluid, the cooling plates can be arranged in series. The number of elements in the series will depend upon the parameters of each installation (nature of the refractory material, type of cooling fluid used, temperature of incoming fluid etc.) so that at the discharge zone of the last plate in the series, the fluid has a maximum temperature that is compatible with the required heat-exchange.

Calculations show that under a very heavy thermal load, the cooling plate in accordance with the invention is subjected only to acceptable stresses due to heat, and that the temperature of the surface zones of the plate remains within the normal limits.

Furthermore, the plate in accordance with the invention enables self-lining to take place. Since the plate is in fact generally very cold during the normal operation, the formation of slag causes the formation of a solid skin which is of fairly low conductivity and limits transfer. When flow ceases, the deposit is consolidated and equilibrium is gradually established between the quantity of heat supplied and absorbability. Such self-lining cannot be achieved in the conventional cooling systems, since it is illusory to suppose that liquid slag will set on a metallic mass which is at 800° C and is saturated as regards transfer capacity. The result is that the slag continues to be renewed and is the cause of excessive overloading of the conventional cooling system, the plate of which begins to melt.

The modified form illustrated in FIGS. 5 to 7 relates to the cooling of the boshes of shaft furnaces and in particular of blast furnaces. In this variation use is made of a plate or screen formed by rolled or extruded finned tubes 62, as in the case of a boiler panel. As can be seen from FIG. 7, these tubes are welded to each other by two of their fins. The inlets 64 and outlets 66 for the cooling fluid are formed individually on two or three rows so as to reduce weakening of the facing at this zone and to permit the use of several independent circulation paths.

What I claim is:

1. A cooling plate for circulating fluid for cooling the walls of shaft furnaces and particularly blast furnaces, the plate being placed between the refractory material to be cooled and the facing of the furnace to be protected, said cooling plate comprising:

a frame formed by two bent tubular elements welded at their ends to separator plates, an independent stream of cooling fluid passing through each tubular element; and a flat hollow central element comprising an inner double-walled panel welded to the inner periphery of the frame, said inner panel forming an enclosure through which passes an independent stream of the cooling fluid.

2. A cooling plate according to claim 1, wherein said inner double-walled panel is divided into passages by partitions which also serve as stiffeners.

3. A plate according to claim 1, further comprising means for supplying cooling fluid to the tubular elements and the inner double-walled panel at the respective lower portions thereof, and discharging means at the respective tops of said tubular elements and said panel so as to achieve upward circulation in the three independent circulation paths thus formed.

4. A plate according to claim 1, further comprising means for protecting the central element, said means comprising a grating secured to the inner wall of said central element and provided with a packing made of a refractory material selected to suit the brickwork of the shaft furnace in which the cooling plate is used.

5. A cooling plate according to claim 1, the plate being provided in a furnace in combination with other similar plates so as to cover a very considerable part of the heat-radiating surface of the furnace while at the same time providing a reliable support for the refractory wall of the furnace.

6. A cooling plate combination in a furnace according to claim 5, in combination with cooling boxes of known type, the cooling boxes further assisting in the cooling and in the provision of a reliable support for said refractory wall.

7. A cooling plate according to claim 1, in a furnace and arranged at right angles to the flow of the heat that is to be dissipated.

8. In a shaft furnace bosh of the type including an outer facing, an inner refractory wall, and at least one cooling plate for cooling the bosh during operation of the furnace, the improvement wherein said cooling plate comprises:

a plurality of vertically extending tubes positioned between said facing and said wall, said tubes being spaced from each other in the circumferential direction of said bosh;

each said tube having spaced circumferentially therearound a plurality of longitudinally extending fins;

fins of adjacent of said tubes being welded together;

each said tube having at a first end thereof a fluid inlet extending outwardly through said facing;

each said tube having at a second end thereof a fluid outlet extending outwardly through said facing; and said inlets being positioned to be aligned in plural horizontal rows, and said outlets being positioned to be aligned in plural horizontal rows, thereby reducing the weakening of said facing in the zones thereof through which said inlets and outlets extend.

* * * * *